US005560503A

United States Patent [19]

Daugherty, Jr.

[11] Patent Number: 5,560,503

[45] Date of Patent: Oct. 1, 1996

[54] LUBRICATING APPARATUS FOR ARTICULATED COUPLING ARRANGEMENT

[75] Inventor: David W. Daugherty, Jr., Bolingbrook, Ill.

[73] Assignee: Westinghouse Air Brake Co., Wilmerding, Pa.

[21] Appl. No.: 545,930

[22] Filed: Oct. 20, 1995

Related U.S. Application Data

[63] Continuation of Ser. No. 166,217, Dec. 13, 1993, abandoned.

[51] Int. Cl.[6] ..... B61G 1/00

[52] U.S. Cl. ..... 213/75 R; 213/188

[58] Field of Search ..... 213/75 R, 7, 188; 105/3, 4.1; 384/299, 300, 297

[56] References Cited

U.S. PATENT DOCUMENTS

| | | | |
|---|---|---|---|
| 2,675,283 | 4/1954 | Thomson | 384/299 |
| 3,236,573 | 2/1966 | Donnellan | 384/299 |
| 4,076,347 | 2/1978 | Meek | 384/299 |
| 4,593,829 | 6/1986 | Altherr | 213/75 R |
| 4,867,071 | 9/1989 | Weber | 105/4.1 |
| 5,065,679 | 11/1991 | Wallace et al. | 213/75 R |

FOREIGN PATENT DOCUMENTS

| | | | |
|---|---|---|---|
| 4306164 | 10/1992 | Japan | 213/75 R |

*Primary Examiner*—Mark T. Le
*Attorney, Agent, or Firm*—J. O. Ray, Jr.

[57] ABSTRACT

An articulated coupling male connection member support assembly having an improved lubrication arrangement incorporated therein. Such support assembly includes a bottom ring bearing member supported on an upper surface of a bottom wall portion of a female connection member adjacent an outer end thereof. The bottom ring bearing member has a concave shaped spherical upper surface. An upper ring bearing member having a convex shaped spherical bottom surface is supported by such concave upper surface of the bottom ring bearing member. The upper ring bearing member has a substantially flat upper surface for supporting a bottom surface of a male connection member adjacent an outer end thereof. There is a substantially solid lubricating liner member disposed between such concave shaped spherical upper surface of the bottom ring bearing member and such convex shaped spherical bottom surface of the upper ring bearing member. This substantially solid lubricating liner member is secured to one of such concave shaped spherical upper surface and such convex shaped spherical bottom surface.

15 Claims, 4 Drawing Sheets

LUBRICATING APPARATUS FOR ARTICULATED COUPLING ARRANGEMENT

This is a continuation of application Ser. No. 08/166,217, filed Dec. 13, 1993 now abandoned.

FIELD OF THE INVENTION

The present invention relates, in general, to articulated type coupling arrangements used in connecting adjacent ends of a pair of railway car body members together in a substantially semipermanent fashion and, more particularly, this invention relates to an improved lubricating arrangement, for such articulated coupling, which utilizes a generally solid lubricant that will substantially minimize the frictional wear of the critical articulating coupling components during in track service.

BACKGROUND OF THE INVENTION

Articulated coupling arrangements are presently used rather extensively, in the railroad industry, to semipermanently connect at least two or more railroad car bodies together in order to form a relatively long railroad vehicle. In this type arrangement there is provided a railroad truck, or bogie, under each articulated type connection for supporting the same, and an additional truck, or bogie, is disposed under each unconnected end of the two outermost end modules of the large railroad vehicle made up of the plurality of individual car modules. The articulated type connector allows for not only the relative horizontal pivotal movement that is needed between adjoining and coupled ends of two adjacent car modules (angling such as in curves), but also it must allow for relative vertical/angling and movements therebetween, in order to accommodate, during operation, track inclines and declines, as well as general differences in the vertical heights of the adjoining ends of the adjacent car modules due to track conditions or tolerances and frictional wear of various components within the articulated connectors.

For a better understanding of the prior art articulated coupling arrangements used extensively, in the railroad industry, reference is now made to each of U.S. Pat. Nos. 4,593,829 and 4,867,071. Each of these patents is incorporated herein by reference thereto.

It can be clearly seen in these patents that, in conventional fashion, the male connection member's lower surface is supported on a convex surface of a spherical ring bearing member. This convex surface cooperates with a lower concave surface of another spherical ring bearing member seated in the annular region located between the hub or sleeve member and an upstanding rim of the wall portion. These spherical ring bearing members, in the conventional manner, allow for the necessary relative shifting and/or angling of both the female and male connector components during both vertical angling and car body roll.

Prior to the present invention, it is well known that a considerable amount of frictional wear occurs to both the working surface of such convex spherical ring bearing member and to the working surface of the lower concave spherical ring bearing member. Such frictional wear of these critical component parts will allow the male connection member to drop, with respect to a horizontal plane, thus causing operating problems with either of these articulated type connectors.

Lubrication of these particular working surfaces is extremely difficult to maintain due to the environment in which the are used. That is, they are oftentimes subjected to considerable amounts of rain water and/or debris during in-track service.

SUMMARY OF THE INVENTION

The present invention provides a lubrication arrangement for use in an articulated type coupling arrangement to substantially minimize friction wear experienced by critical components of the coupling system and thereby significantly reduce the maintenance requirements.

More specifically, in a first aspect thereof, this invention provides an articulated coupling male connection member support assembly having an improved lubrication arrangement incorporated therein. The support assembly includes a bottom ring bearing member supported on an upper surface of a bottom wall portion of a female connection member adjacent an outer end thereof. Such bottom ring bearing member has a concave shaped spherical upper surface. An upper ring bearing member, having a convex shaped spherical bottom surface, is supported by such concave upper surface of the bottom ring bearing member. This upper ring bearing member includes a substantially flat upper surface for supporting a bottom surface of a male connection member disposed adjacent an outer end thereof. There is a substantially solid lubricating liner member disposed between such concave shaped spherical upper surface of the bottom ring bearing member and such convex shaped spherical bottom surface of the upper ring bearing member. Such substantially solid lubricating liner member is secured to one of the concave shaped spherical upper surface and the convex shaped spherical bottom surface.

In a second and final aspect of this invention, there is provided an improved lubrication arrangement for an articulated coupling system used to connect adjacent ends of a pair of railway cars together in a substantially semipermanent manner. The improved lubrication arrangement includes a bottom ring bearing member supported on an upper surface of a bottom wall portion of a female connection member adjacent an outer end thereof. Such bottom ring bearing member includes a concave shaped spherical upper surface. An upper ring bearing member has a convex shaped spherical bottom surface supported by such concave shaped upper surface of the bottom ring bearing member. This upper ring bearing member has a substantially flat upper surface for supporting a bottom surface of a male connection member adjacent an outer end thereof. There is a substantially solid lubricating liner member disposed between such concave shaped spherical upper surface of the bottom ring bearing member and such convex shaped spherical bottom surface of the upper ring bearing member. The substantially solid lubricating liner member is secured to one of such concave shaped spherical surface and such convex shaped spherical surface. This embodiment of the invention also includes a generally round cup-shaped wear liner assembly, having a first predetermined outer diameter and a first predetermined inner diameter. Such wear liner assembly includes a first generally round bottom plate portion having a first predetermined thickness. A first centrally disposed aperture, having a first predetermined diameter, is formed through such first bottom plate portion, and a first upstanding generally round wall portion, having such first predetermined thickness and a first predetermined height, is connected at a bottom portion thereof to an outer perimeter of the first bottom plate portion. A lubricating liner assembly is provided which includes at least one substantially flat solid lubricating material having a bottom surface disposed adjacent and in contact with an upper surface of such bottom plate portion of the wear liner assembly. Such lubricating liner assembly also has a vertically disposed ring-like substantially solid lubricating material, having a second predetermined height. An outer surface of this ring-like lubricating material is disposed adjacent and in contact with an inner surface of such upstanding wall portion of the wear liner assembly. A protective cover member, having a second predetermined outer diameter and a second predetermined inner diameter, is provided. The protective cover member includes a second generally round bottom plate portion, having a second predetermined thickness. A bottom surface of such second bottom plate portion is disposed adjacent and in contact with an upper surface of such at least one substantially solid lubricating material. A second centrally disposed aperture, having a second predetermined diameter, is formed through such second bottom plate portion and a second upstanding generally round wall portion, having such second predetermined thickness and a third predetermined height, is connected at a bottom portion thereof to an outer perimeter of such second bottom plate portion. There is an annular lip-like portion connected adjacent an inner edge thereof to an upper edge of such second upstanding wall portion. This lip-like portion extends outwardly from the upper edge of such second upstanding wall portion and downwardly towards a top surface of such bolster bowl. The final essential element, in this arrangement, is an annular space disposed between an inner surface of such ring-like lubricating material and an outer surface of such second upstanding wall portion. A width of such annular space being predetermined.

OBJECTS OF THE INVENTION

It is, therefore, one of the primary objects of the present invention to provide an improved lubrication arrangement for lubricating certain predetermined critical components of an articulated type coupling arrangement.

Another object of the present invention is to provide an improved lubricating arrangement for an articulated type coupling arrangement which will substantially reduce the wear experienced on certain critical components.

Still another object of the present invention is to provide an improved lubricating arrangement for an articulated type coupling arrangement which will substantially reduce the maintenance cost.

Yet another object of the present invention is to provide an improved lubricating arrangement for an articulated type coupling arrangement which can utilize a generally solid type lubricating material.

A further object of the present invention is to provide an improved lubricating arrangement for an articulated type coupling arrangement which can be readily retrofitted to existing railroad cars.

An additional object of the present invention is to provide an improved lubricating arrangement for an articulated type coupling arrangement which can prolong the useful life of the articulated type coupling arrangement.

Still yet another object of the present invention is to provide an improved lubricating arrangement for an articulated type coupling arrangement which is easy to install and does not require any special installation equipment.

It is an additional object of the present invention to provide an improved lubricating arrangement which will not be adversely affected by moisture during service.

In addition to the various objects and advantages of the improved lubricating apparatus for an articulated type coupling arrangement described above, various other objects and advantages of the instant invention will become more readily apparent to those persons who are skilled in the railway car coupling art from the following more detailed description of the invention, particularly, when such description is taken in conjunction with the attached drawing Figures and with the appended claims.

BRIEF DESCRIPTION OF THE PRESENTLY PREFERRED EMBODIMENTS OF THE INVENTION

Figure 1:
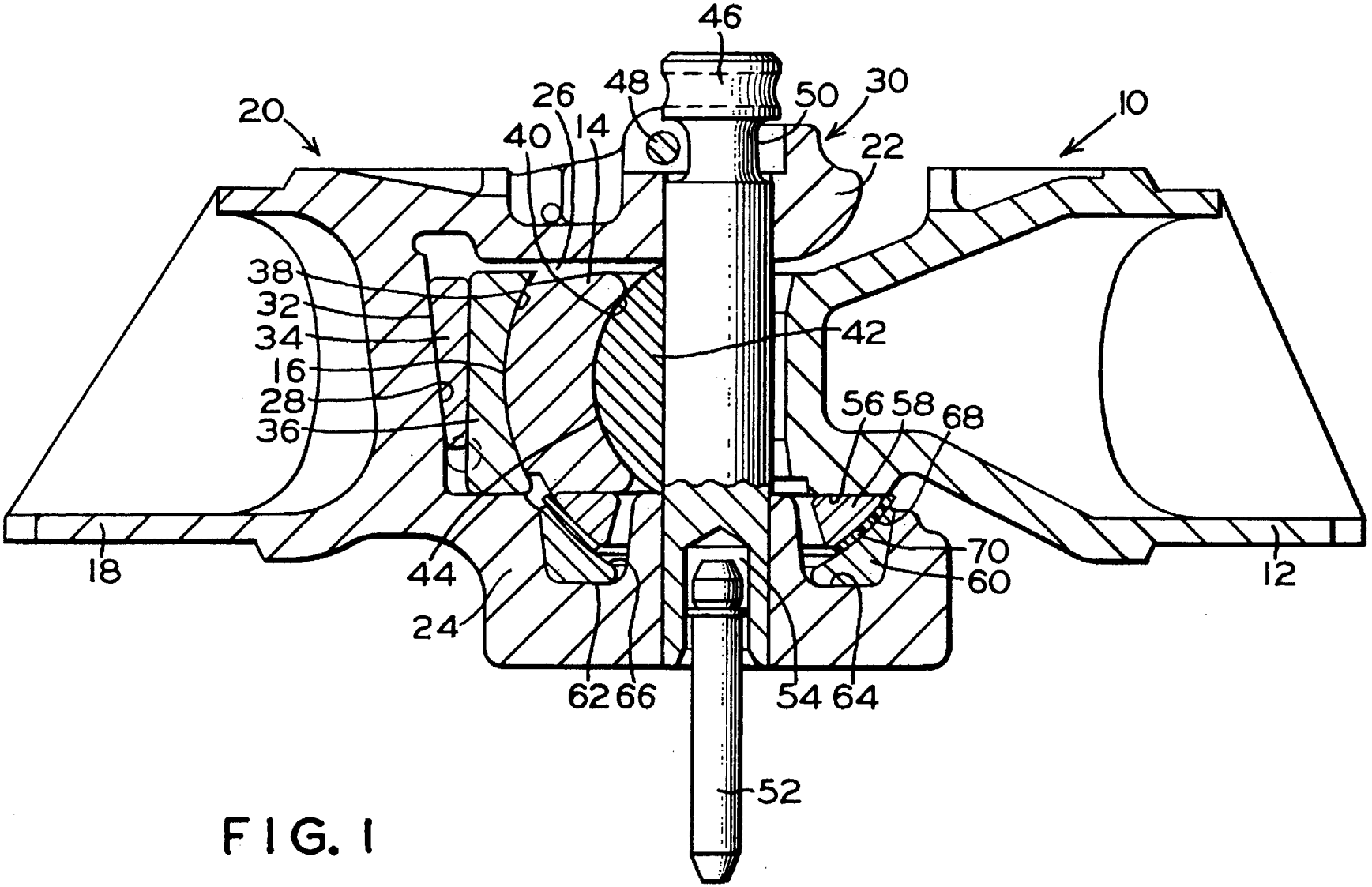
FIG. 1 is a longitudinal cross-sectional view of one embodiment of the present invention.

Prior to proceeding to the more detailed description of the present invention, it should be noted that, for the sake of clarity, identical components, having identical functions, have been identified with identical reference numerals throughout the several views illustrated in the drawings.

Refer now, more particularly, to FIGS. 1 through 6, wherein details of a number of articulated railway car coupler arrangements are illustrated.

Each of the arrangements illustrated generally include a male connection member 10 which has an elongated shank portion 12 and an outer end or butt portion 14 having an arcuate convex surface 16.

Each of the illustrated arrangements further include a female connection member 20 which has an elongated shank portion 18 and an outer end portion, generally designated, 30. Each outer end portion 30 has a top wall portion 22, a bottom wall portion 24 and connecting side wall portions which combine to form a cavity 26. It can be seen that such cavity 26 may or may not have a sloped rear wall 28.

Figure 2:
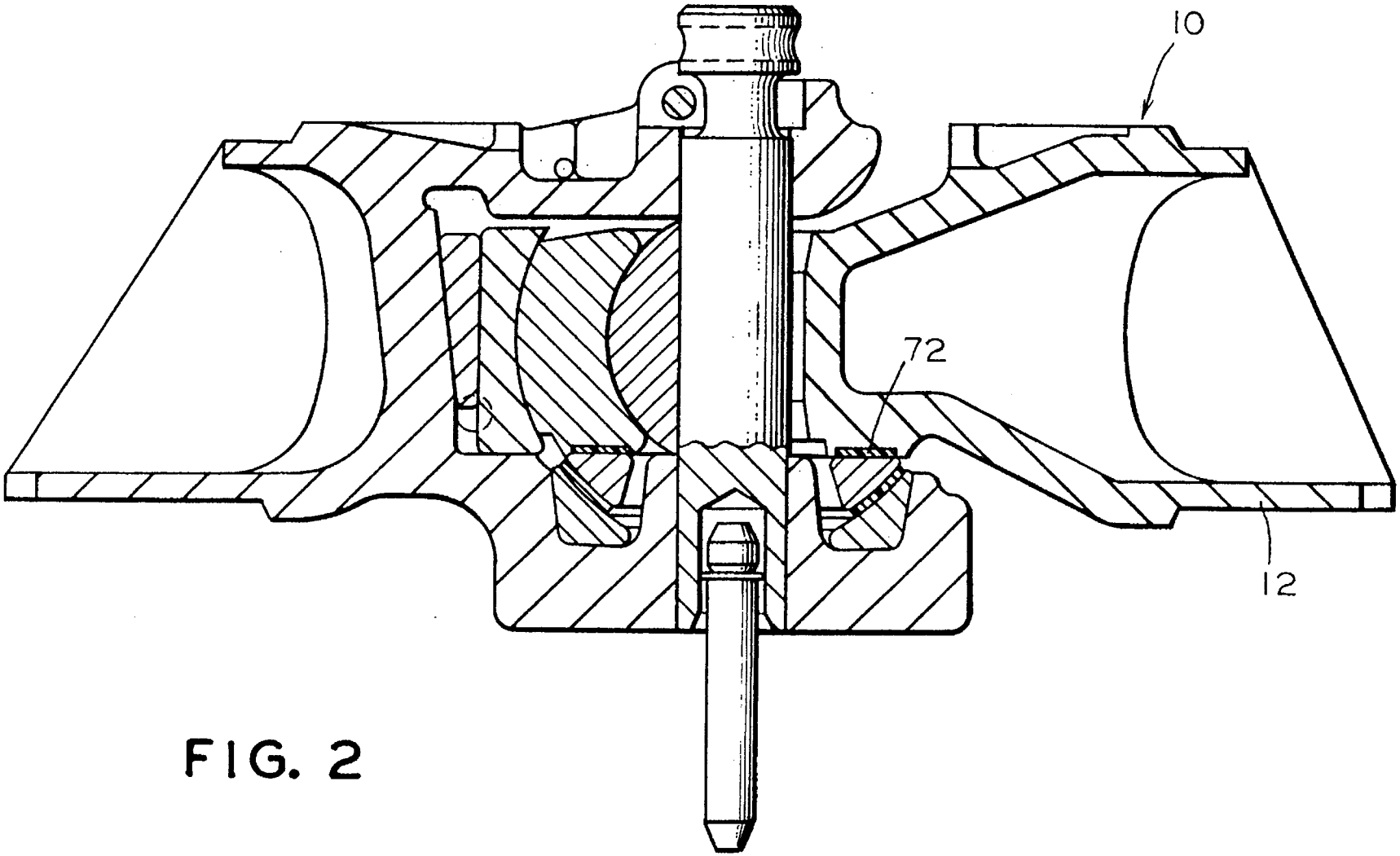
FIG. 2 is a longitudinal cross-sectional view showing an alternative embodiment of the invention illustrated in FIG. 1.

Reference is now made to FIGS. 1 and 2, wherein one of the various embodiments of the invention is shown. In this embodiment, abutting rear wall 28 is the sloped rear surface 32 of a wedge shim member 34 which is located within the cavity 26. Also located within cavity 26, in this embodiment, is a follower block member 36 which has an arcuate concave front surface 38. Arcuate convex surface 16 of the butt end portion 14 abuts the concave front surface 38 of such follower block member 36.

Butt end portion 14 of such male connecting member 10 has an inner arcuate concave surface 40. A pin bearing block 42 has an outer arcuate convex surface 44 that abuts the butt end portion of surface 40. A cylindrical pin member 46 is disposed within a hole located in the top wall portion 22 and the bottom wall portion 24 of the female connecting member 20. Such connecting pin member 46 passes through a vertical hole disposed in the male connecting member 10, thereby connecting such male and female connecting members 10 and 20, respectively, in an articulated coupling arrangement. A retaining pin 48 is located within a portion of the top wall 22 and partially in a groove 50 located in the top of pin member 46, and a center pin 52 is located in a cavity 54 in the bottom of pin 46.

The butt end portion 14 of male connecting member 10 has a generally flat and circular lower surface 56 which rests on an upper ring bearing member 58. The upper ring bearing member 58 itself rests on a bottom ring bearing member 60 which is located within a generally circular cavity 62 in the bottom wall 24 of such female connecting member 20.

In a presently preferred embodiment of the invention, the bottom ring bearing member 60 is supported on an upper surface 64 of the bottom wall portion 24 of such female connection member 20 adjacent an outer end thereof. Such bottom ring bearing member 60 having a concave shaped spherical upper surface 66. Such upper ring bearing member 58 has a convex shaped spherical bottom surface 68 supported by such concave upper surface 66 of the bottom ring bearing member 60. The upper ring bearing member 58 includes a substantially flat upper surface for supporting a bottom surface 56 of the male connection member 10 adjacent an outer end 14 thereof.

Additionally, there is a substantially solid lubricating liner member 70 disposed between such concave shaped spherical upper surface 66 of such bottom ring bearing member 60 and the convex shaped spherical bottom surface 68 of such upper ring bearing member 58. Such substantially solid lubricating liner member 70 is secured to one of such concave shaped spherical upper surface 66 and such convex shaped spherical bottom surface 68. Preferably, such lubricating liner 70 will be secured to the convex shaped bottom surface 68 of such upper ring bearing member 58. It is further preferred that such lubricating liner 70 will be produced from a lubricating polymer. Preferably, the lubricating liner 70 is secured to such convex shaped bottom surface 68 of such upper ring bearing member 58 by an adhesive.

Figure 5:
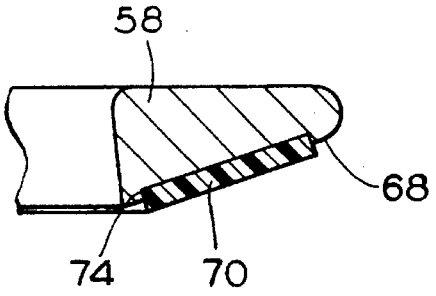
FIG. 5 is a cross-sectional view which illustrates still another embodiment of the invention which can be used with all of the embodiments illustrated.

The present invention, as seen in FIG. 5, also contemplates providing such convex shaped spherical bottom surface 68 of such upper ring bearing member 58 with a recess 74 formed therein. In this case, such substantially solid lubricating liner 70 is secured within the recess 74 and extends outwardly therefrom for a predetermined distance.

In the alternative embodiment illustrated in FIG. 2, the support assembly further includes a substantially solid lubricating liner member 72 disposed between such substantially flat upper surface of such upper ring bearing member 58 and such bottom surface 56 of such male connection member 10. It is expected that such substantially solid lubricating liner 72 can be secured to either the substantially flat upper surface of such upper ring bearing member 58 or to the bottom surface 56 of such male connection member 10.

Figure 3:
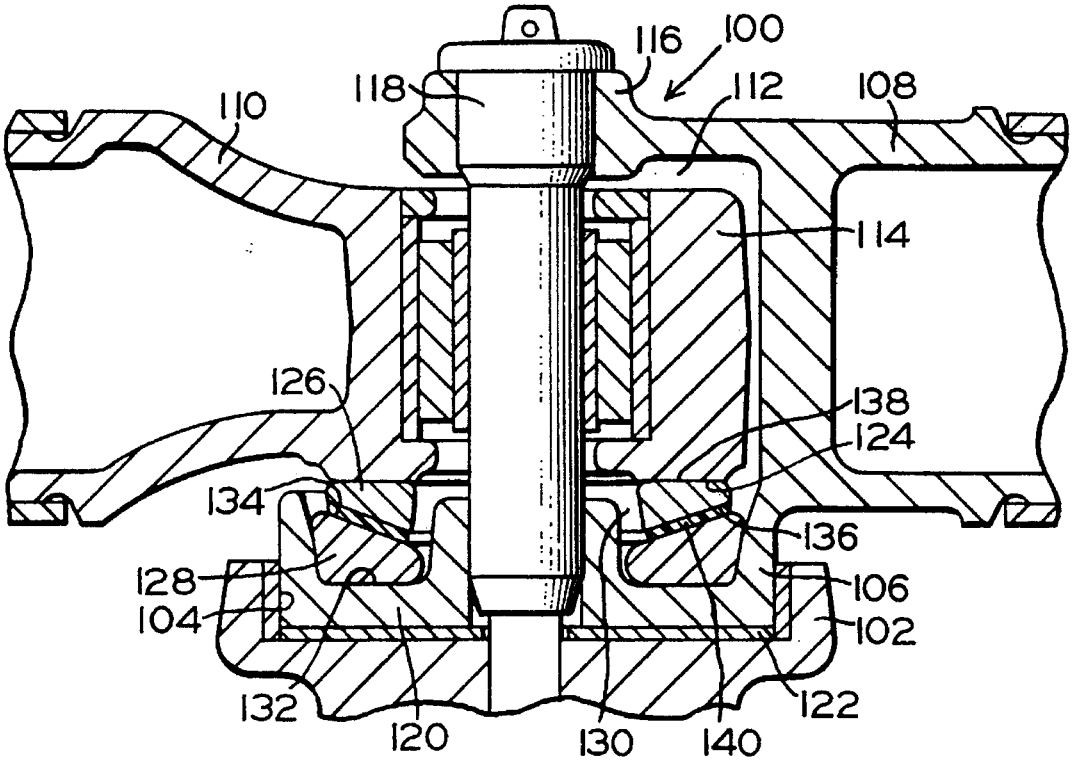
FIG. 3 is a longitudinal cross-sectional view of another alternative embodiment of the present invention for use on a different style articulated coupling arrangement.
Figure 4:
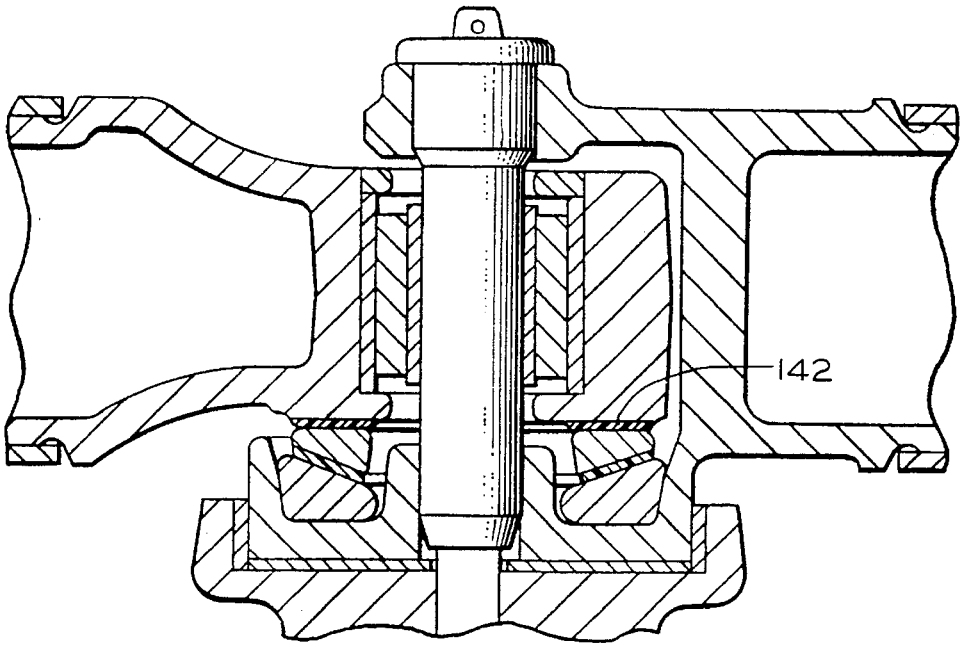
FIG. 4 is a longitudinal cross-sectional view of yet another alternative embodiment of the invention illustrated in FIG. 3.

Refer now, more particularly, to FIGS. 3 and 4 of the drawings in which the environment in which another alternative embodiment of the invention is depicted. As is known, the adjacent ends (not shown) of a pair of railway cars can be articulately interconnected together via the connector or coupler 100.

Such connector 100 is supported on a lower truck or bogie 102 in conventional known fashion via the truck center bowl 104 thereof supporting the lower center plate 106 formed in the lower portion of the female part 108 of the connector 100.

The connector 100 includes the female connector part 108 which is secured to the center sill member (not shown) of one end (not shown) of a railway car and a male connector part 110 which is welded to the center sill member (not shown) at an adjacent end (not shown) of another railway car. The female connector part 108 defines an interior chamber 112 at an outer end thereof into which is telescopingly received the protruding portion 114 of the male connector part 110. The chamber 112 is delimited by an upper horizontal wall portion 116 having a vertical bore therethrough for passing a king pin 118, and a lower horizontal wall portion 120. The lower horizontal wall portion 120 projects downwardly in order to form a lower center plate, which is received in the truck center bowl 104 of the truck or bogie 102, whereby the connector unit 100 is supported thereby and allows for a limited amount of horizontal rotational movement in the conventional manner. A wear liner 122 is also provided.

The male connector part 110 includes the forward telescoping portion 114 which is telescopingly received within the cavity or chamber 112.

In conventional fashion, the male member's lower surface 124 is supported on an upper spherical ring bearing member 126, having a convex shaped bottom surface, which cooperates with a lower spherical ring bearing member 128 seated in the annular region 130 located between the hub or sleeve and the upstanding rim of the bottom wall portion 120. These ring bearings 126 and 128, in the conventional manner, allow for the necessary relative shifting and angling of the female and male connector parts 108 and 110, respectively, during vertical angling and car roll.

In this alternative embodiment of the invention, the bottom ring bearing member 128 is supported on an upper surface 132 of the bottom wall portion 120 of such female connection member 108 adjacent an outer end thereof. Such bottom ring bearing member 128 having a concave shaped spherical upper surface 134. Such upper ring bearing member 126 has a convex shaped spherical bottom surface 136 supported by such concave upper surface 134 of the bottom ring bearing member 128. The upper ring bearing member 126 includes a substantially flat upper surface 138 for supporting such bottom surface 124 of the male connection member 110 adjacent an outer end 114 thereof.

Additionally, there is a substantially solid lubricating liner member 140 disposed between such concave shaped spherical upper surface 134 of such bottom ring bearing member 128 and the convex shaped spherical bottom surface 136 of such upper ring bearing member 126. Such substantially solid lubricating liner member 140 is secured to one of such concave shaped spherical upper surface 134 and such convex shaped spherical bottom surface 136.

Preferably, such lubricating liner 140 will be secured to the convex shaped bottom surface 136 of such upper ring bearing member 126. It is further preferred that such lubricating liner 140 will be produced from a lubricating polymer.

The present invention, as seen in FIG. 5, also contemplates providing such convex shaped spherical bottom surface of such upper ring bearing member with a recess 74 formed therein. In this case, such substantially solid lubricating liner is secured within the recess 74 and extends outwardly therefrom for a predetermined distance.

In the alternative embodiment illustrated in FIG. 4, the support assembly further includes a substantially solid lubricating liner member 142 disposed between such substantially flat upper surface 138 of such upper ring bearing member 126 and such bottom surface 124 of such male connection member 110. It is expected that such substantially solid lubricating liner 142 can be secured to either the substantially flat upper surface 138 of such upper ring bearing member 126 or to the bottom surface 124 of such male connection member 110.

Thus, unlike the prior art spherical surfaces, it is further expected that the longitudinal center lines of the male and female connecting members will remain in a coextensive manner for a much greater period of time.

Figure 6:
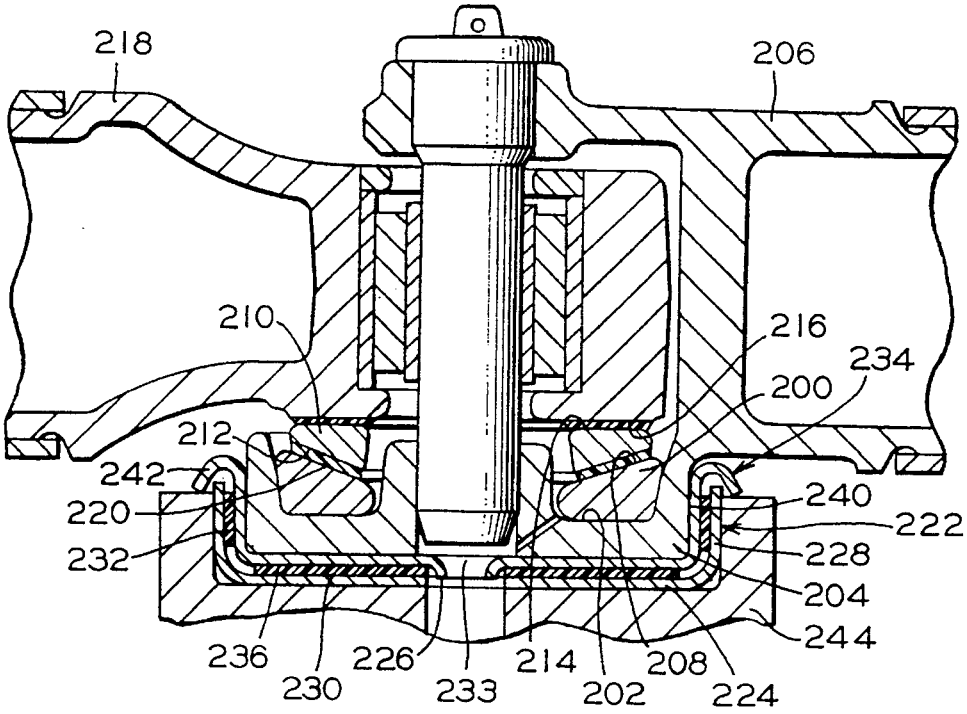
FIG. 6 is a cross-sectional view which illustrates a further alternative embodiment of the invention which can be used with all of the illustrated embodiments.

For a final aspect of the present invention reference is made to FIG. 6. Illustrated therein is an improved lubrication arrangement for an articulated coupling system used to connect adjacent ends of a pair of railway cars together in a substantially semipermanent manner.

This lubrication arrangement includes a bottom ring bearing member 200 supported on an upper surface 202 of a bottom wall portion 204 of a female connection member 206 adjacent an outer end thereof. Such bottom ring bearing member 200 having a concave shaped spherical upper surface.

There is an upper ring bearing member 210 having a convex shaped spherical bottom surface. Such convex shaped spherical bottom surface 212 is supported by such concave shaped upper surface of the bottom ring bearing member 200. The upper ring bearing member 210 has a substantially flat upper surface 214 for supporting a bottom surface 216 of a male connection member 218 adjacent an outer end thereof.

This embodiment of the invention further includes a substantially solid lubricating liner member 220 disposed between such concave shaped spherical upper surface of the bottom ring bearing member 200 and such convex shaped spherical bottom surface of the upper ring bearing member 210. The substantially solid lubricating liner member 220 is secured to one of such concave shaped spherical surface and such convex shaped spherical surface.

As illustrated in FIG. 6, this embodiment of the invention further incorporates the wear and lubricating liner assembly taught and claimed in a copending application titled "IMPROVED COMBINATION WEAR AND LUBRICATING LINER ASSEMBLY FOR RAILWAY CAR TRUCK BOLSTER BOWL" filed Nov. 18, 1995 and having Ser. No. 08/154, 189 now U.S. Pat. No. 5,423,275. This application is owned by the assignee of the present invention and is incorporated herein by reference thereto.

Such wear and lubricating liner assembly includes a generally round cup-shaped wear liner assembly 222, having a first predetermined outer diameter and a first predetermined inner diameter. The wear liner assembly includes a first generally round bottom plate portion 224, having a first predetermined thickness. A first centrally disposed aperture 226, having a first predetermined diameter, is formed through such first bottom plate portion 224. There is a first upstanding generally round wall portion 228, having such first predetermined thickness and a first predetermined height, connected at a bottom portion thereof to an outer perimeter of such first bottom plate portion 224.

The wear liner assembly also has a lubricating liner assembly. Such lubricating liner assembly includes at least one substantially flat solid lubricating material 230 which has a bottom surface disposed adjacent and in contact with an upper surface of such bottom plate portion 224 of the wear liner assembly and a vertically disposed ring-like substantially solid lubricating material 232, having a second predetermined height. An outer surface of such ring-like lubricating material 232 is disposed adjacent and in contact with an inner surface of the upstanding wall portion 228 of such wear liner assembly.

Another element of the wear and lubricating liner assembly is a protective cover member 234, having a second predetermined outer diameter and a second predetermined inner diameter. This protective cover member 234 includes a second generally round bottom plate portion 236, having a second predetermined thickness. A bottom surface of such second bottom plate portion 236 is disposed adjacent and in contact with an upper surface of such at least one substantially solid lubricating material 230. A second centrally disposed aperture 238, having a second predetermined diameter, is formed through such second bottom plate portion 236. The protective cover member 234 has a second upstanding generally round wall portion 240, having such second predetermined thickness and a third predetermined height, connected at a bottom portion thereof to an outer perimeter of such second bottom plate portion. An annular lip-like portion 242 is connected adjacent an inner edge thereof to an upper edge of such second upstanding wall portion 240. The lip-like portion 242 extends outwardly from the upper edge of such second upstanding wall portion 240 and downwardly towards a top surface of such bolster bowl 244.

A final essential element of such wear and lubricating liner is an annular space disposed between an inner surface of such ring-like lubricating material 232 and an outer surface of such second upstanding wall portion 240, a width of said annular space being predetermined.

Although a number of presently preferred and alternative embodiments of the present invention have been described in detail above, it should be understood that various other modifications and adaptations can be made to the lubricating arrangement for an articulated coupling system, by those persons skilled in the art, without departing from the spirit and scope of the appended claims.

I claim:

1. In an articulated coupling arrangement having a male connection member and a female connection arrangement having a male connection member and a female connection member, the improvement comprising a support assembly for such male connection member having an improved lubrication arrangement incorporated therein, said support assembly having said improved lubricating arrangement incorporated therein including:

(a) a bottom ring bearing member supported on an upper surface of a bottom wall portion of such female connection member adjacent an outer end thereof, said bottom ring bearing member having a concave shaped spherical upper surface;

(b) an upper ring bearing member having a convex shaped spherical bottom surface supported by said concave upper surface of said bottom ring bearing member, said upper ring bearing member having a substantially flat upper surface for supporting a bottom surface of such male connection member adjacent an outer end thereof; and (c) a substantially solid lubricating liner member disposed between said concave shaped spherical upper surface of said bottom ring bearing member and said convex shaped spherical bottom surface of said upper ring bearing member, said substantially solid lubricating liner member being secured to one of said concave shaped spherical upper surface and said convex shaped spherical bottom surface and being of a predetermined thickness sufficient to space said upper ring member over said bottom ring member to maintain a longitudinal center line of said male connection member coextensive with a longitudinal center line of said female connection member.

2. The combination, according to claim 1, wherein said support assembly further includes a substantially solid lubricating liner disposed between said substantially flat upper surface of said upper ring bearing member and said bottom surface of such male connection member.

3. The combination, according to claim 2, wherein said substantially solid lubricating liner is secured to one of said substantially flat upper surface of said upper ring bearing member and said bottom surface of said male connection member.

4. The combination, according to claim 3, wherein said substantially solid lubricating liner is secured to said substantially flat upper surface of said upper ring bearing member.

5. The combination, according to claim 4, wherein said substantially solid lubricating liner is secured to said substantially flat upper surface of said upper ring bearing member by an adhesive.

6. The combination, according to claim 4, wherein said upper ring bearing member further includes a recess formed in said substantially flat upper surface thereof and said substantially solid lubricating liner is secured in said recess and extends outwardly therefrom for a predetermined distance.

7. The combination, according to claim 1, wherein said substantially solid lubricating liner member is secured to said convex shaped spherical bottom surface of said upper ring bearing member.

8. The combination, according to claim 7, wherein said substantially solid lubricating liner member is formed from a lubricating polymer.

9. The combination, according to claim 8, wherein said convex shaped spherical bottom surface of said upper ring bearing member further includes a recess formed therein and said substantially solid lubricating liner member is secured within said recess and extends outwardly therefrom for a predetermined distance.

10. The combination, according to claim 1, wherein said support assembly having said improved lubricating arrangement incorporated therein can be retrofitted to existing articulated coupling arrangements.

11. The combination, according to claim 1, wherein said substantially solid lubricating liner member is secured to said concave spherical upper surface of said bottom ring bearing member.

12. The combination, according to claim 11, wherein said substantially solid lubricating liner member is formed from a lubricating polymer.

13. The combination, according to claim 12, wherein said concave shaped spherical upper surface of said bottom ring bearing member further includes a recess formed therein and said substantially solid lubricating liner member is secured within said recess and extends outwardly therefrom for a predetermined distance.

14. The combination, according to claim 13, wherein said substantially solid lubricating liner member is secured within said recess with an adhesive.

15. The combination, according to claim 9, wherein said substantially solid lubricating liner member is secured within said recess with an adhesive.

* * * * *